US007759040B2

(12) United States Patent
Mizutani et al.

(10) Patent No.: US 7,759,040 B2
(45) Date of Patent: Jul. 20, 2010

(54) IMAGE FORMING METHOD

(75) Inventors: Noriyuki Mizutani, Kanagawa (JP); Yuusaku Shibuya, Kanagawa (JP); Masanobu Ninomiya, Kanagawa (JP); Toshiyuki Yano, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 1021 days.

(21) Appl. No.: 10/962,699

(22) Filed: Oct. 13, 2004

(65) Prior Publication Data

US 2005/0214671 A1 Sep. 29, 2005

(30) Foreign Application Priority Data

Mar. 24, 2004 (JP) ..... 2004-085931

(51) Int. Cl.
*G03G 9/107* (2006.01)

(52) U.S. Cl. ..... 430/110.3; 430/110.1; 430/111.32; 430/111.35; 430/111.41; 430/119.86; 430/122.2

(58) Field of Classification Search ..... 430/110.1, 430/110.3, 111.1, 111.32, 111.35, 111.41, 430/137.14, 119.86, 122.2, 123.51, 123.58, 430/123.5

See application file for complete search history.

(56) References Cited

U.S. PATENT DOCUMENTS

| | | | | |
|---|---|---|---|---|
| 5,396,317 | A | 3/1995 | Osawa et al. | |
| 5,541,031 | A | 7/1996 | Yamashita et al. | |
| 5,576,393 | A | 11/1996 | Yamashita et al. | |
| 5,766,814 | A * | 6/1998 | Baba et al. | 430/111.32 |
| 5,849,448 | A * | 12/1998 | Yoshino et al. | 430/111.1 |
| 6,096,466 | A * | 8/2000 | Imai et al. | 430/123.58 |
| 6,101,358 | A * | 8/2000 | Imai et al. | 430/122.4 |
| 6,403,271 | B1 | 6/2002 | Suzuki et al. | |
| 6,479,206 | B1 | 11/2002 | Suzuki et al. | |
| 6,489,075 | B2 | 12/2002 | Suzuki et al. | |
| 2004/0197693 | A1 * | 10/2004 | Ninomiya et al. | 430/108.7 |
| 2005/0202332 | A1 * | 9/2005 | Ninomiya et al. | 430/110.3 |

FOREIGN PATENT DOCUMENTS

| | | |
|---|---|---|
| JP | A 49-91231 | 8/1974 |
| JP | A 56-40868 | 4/1981 |
| JP | A 60-225870 | 11/1985 |
| JP | A 03-231756 | 10/1991 |
| JP | A 06-214422 | 8/1994 |
| JP | A 08-190227 | 7/1996 |
| JP | A 10-142897 | 5/1998 |
| JP | A 10-240004 | 9/1998 |
| JP | A 10-254291 | 9/1998 |
| JP | A 11-052610 | 2/1999 |
| JP | A 2001-051444 | 2/2001 |
| JP | A 2001-066820 | 3/2001 |

OTHER PUBLICATIONS

Grant, R., et al., ed., Grant & Hackh's Chemical Dictionary,Fifth edition, McGraw Hill Book Company, NY (1987), pp. 232 and 349.*
Kirk-Othmer Encyclopedia of Chemical Technology, Fourth Edition, vol. 15, John Wiley & Sons, NY (1995), pp. 725-727.*

* cited by examiner

*Primary Examiner*—Janis L Dote
(74) *Attorney, Agent, or Firm*—Oliff & Berridge, PLC

(57) ABSTRACT

A cleaner-less image forming method includes forming an electrostatic latent image on a electrostatic latent image carrying member; developing the electrostatic latent image with a developer comprising a toner and a carrier to form a toner image; and transferring the toner image. The carrier has a median of an arithmetic average height distribution of from 0.45 to 0.65 μm, and the toner includes an external additive and has an average circularity of 0.975 or more.

16 Claims, No Drawings

IMAGE FORMING METHOD

BACKGROUND OF THE INVENTION

1. Field of the Invention

The present invention relates to a method for forming an image for developing an electrostatic latent image in an electrophotographic method or an electrostatic recording method.

2. Description of the Related Art

In the image forming method utilizing electrophotography, generally, an image is formed by using an electrostatic latent image carrying member in a drum or belt form (hereinafter, sometimes referred to as an electrophotographic photoreceptor) in the following manner. After uniformly charging the surface of the electrostatic latent image carrying member with a charging unit, the surface of the electrostatic latent image carrying member is irradiated in the form of an optical image corresponding to image information to form an electrostatic latent image, and then the latent image is developed with a developing unit for feeding a developer according to a developing method to form a toner image. Thereafter, the toner image is electrostatically transferred to a recording sheet, such as paper, or electrostatically transferred to a recording sheet through an intermediate transfer material. Unnecessary matters, such as the non-transferred toner, remaining on the surface of the electrostatic latent image carrying member after transfer are then removed by cleaning according to a cleaning method, and the electrostatic latent image carrying member is prepared for the next image formation process.

In the cleaning method of the aforementioned image forming method, such a method is frequently employed that a cleaning blade formed, for example, with rubber, is pressed on the surface of the rotating electrostatic latent image carrying member to remove and recover the unnecessary matters, such as the non-transferred toner, and thus the following problems arise. The cleaning blade gradually abrades the surface of the electrostatic latent image carrying member to deteriorate the characteristics of the electrostatic latent image carrying member, and thus the service life thereof is reduced, which is a disadvantageous factor for improvement in service life. Furthermore, in general, the toner removed and recovered with the cleaning blade is stored in a recovery container disposed inside the apparatus and then discarded periodically, or is stored in a recovery part attached to a disposable cartridge member and then discarded along with the cartridge having the recovery part. The discard of the toner is not preferred from the standpoint of environmental protection and is necessarily refrained.

In recent years, accordingly, an image forming method using a so-called blade cleaner-less system equipped with no blade cleaning mechanism has been proposed for avoiding abrasion of the surface of the electrostatic latent image carrying member with the cleaning blade. In the case where the cleaner-less system is employed, a so-called spherical toner, i.e., a toner formed into a spherical form, for example, by an emulsion polymerization and integration process or a suspension polymerization process. According to the process, the transferring rate of the developed image on the electrostatic latent image carrying member is improved to reduce the amount of the non-transferred toner remaining on the surface of the electrostatic latent image carrying member, whereby the step of cleaning the surface of the electrostatic latent image carrying member after transferring can be omitted.

Such a measure is also employed that the non-transferred toner remaining on the surface of the electrostatic latent image carrying member is recovered through a developing roll for the developing method (i.e., developing device cleaning) to make the device function as a cleaning device.

However, the cleaner-less image forming method involves the following problems. The surface of the electrostatic latent image carrying member suffers attachment of discharge products, such as a nitric acid compound, formed upon discharge in the charging step and the transferring step, whereby the resistance of the surface of the photoreceptor is decreased, and the electrostatic characteristics thereof are deteriorated, so as to cause, for example, white dropout (image blur). There is such a tendency that the white dropout due to attachment of the discharge products conspicuously appears under high temperature and high humidity conditions.

As a cleaner-less image forming method that avoids the attachment of the discharge products and the contamination of the surface of the electrostatic latent image carrying member, for example, JP-A-10-240004 discloses such a method using the developing device cleaning that the surface of the electrostatic latent image carrying member is abraded by changing the peripheral velocity of the developing roll between the step of forming an image and the step of cleaning. JP-A-10-254291 discloses such a method that a unit for scraping the surface of the electrostatic latent image carrying member (such as a brush, a roller or a web in contact with the surface of the electrostatic latent image carrying member) is provided between the transferring unit and the charging unit, whereby the surface of the electrostatic latent image carrying member is abraded in a prescribed amount. However, these techniques are associated with abrasion of the electrostatic latent image carrying member to reduce the service life of the electrostatic latent image carrying member, and thus is disadvantageous in improvement of the service life of the electrostatic latent image carrying member.

It is the current status that the charging technique is shifted from the conventional non-contact charging method utilizing corona discharge to the contact charging method using a member in contact with the electrostatic latent image carrying member.

In the contact charging method, an electroconductive elastic roller is made in contact with the electrostatic latent image carrying member, and the electrostatic latent image carrying member is uniformly charged by applying a voltage to the electroconductive elastic roller. In the contact charging method, discharge is liable to occur immediately before and immediately after the contact of the charging device with the electrostatic latent image carrying member. Therefore, discharge products, such as a nitric acid compound, are liable to form to cause image white dropout (image blur) particularly under high temperature and high humidity conditions, as compared to the conventional corona discharge method.

Furthermore, since the charging device and the electrostatic latent image carrying member are in contact with each other, a toner is fixed and accumulated on the charging device, the transferring member and the electrostatic latent image carrying member in the case where the toner remains even in a slight amount due to insufficient transfer and fogging upon development, whereby image defects occur due to charging of transferring failure in long term use.

Consequently, in the image forming method using no elastic blade or using no cleaning mechanism, particularly in the image forming method using a contact charging device, such a function is necessary that effectively removes the discharge products and the toner remaining in a slight amount.

It has been also proposed that, instead of the elastic blade, a brush is pressed on the electrostatic latent image carrying member with a small pressure to clean the electrostatic latent image carrying member. The cleaning method using a brush is advantageous in such a point that the surface of the electrostatic latent image carrying member is suppressed from being deteriorated, and it is sufficient to collect the toner remaining in a slight amount while the toner collecting amount is smaller than that of the elastic blade. However, there is such a problem that collecting power of the fixed remaining toner is small in comparison to the elastic blade.

There have been proposed that in an image forming method using a cleaning unit, the surface of the electrostatic latent image carrying member is coated with a cleaning assistant for improving the cleaning property or a lubricant for reducing flaws and abrasion of the surface of the electrostatic latent image carrying member on the cleaning part. However, these measures cannot be an effective solution due to the following problems.

For example, JP-A-60-225870 discloses an image forming method, in which a cleaning assistant coating unit for coating the aforementioned cleaning assistant with a foamed body having the cleaning assistant attached thereto is disposed at a position on a periphery of an electrostatic latent image carrying member on a downstream side of the blade cleaning system and an upstream side of the charging unit. However, in the case where the contact charging system, in which a charging member charges the surface of the electrostatic latent image carrying member by making it in contact therewith, is employed in this image forming method, there is such a possibility that the cleaning assistant is attached to the surface of the charging member to induce charging failure, which brings about deterioration in image quality.

JP-A-10-142897 discloses an image forming method, in which a coating mechanism for coating the aforementioned lubricant on a charging roller is provided, and a lubricant coating assisting member, such as a blade, in contact with the surface of the electrostatic latent image carrying member is provided on a periphery of the electrostatic latent image carrying member on a downstream side of the charging roller and an upstream side of a developing unit, whereby the lubricant fed onto the electrostatic latent image carrying member is coated into a film form before reaching the developing unit. In the image forming method, however, since the lubricant coating assisting unit is provided to be made in contact with the surface of the electrostatic latent image carrying member after the charging unit and after coating the lubricant, there is such a possibility that uniformity of the surface potential of the electrostatic latent image carrying member is deteriorated due to frictional charge between the assisting member and the surface of the electrostatic latent image carrying member, so as to cause deterioration in image quality.

SUMMARY OF THE INVENTION

The present invention has been made in view of the above circumstances and provides such a method for forming an image that does not induce problems, such as charging failure, and can certainly prevent deterioration in image quality, such as white dropout of an image, caused by attachment of a discharge product or a residual toner remaining on the surface of the electrostatic latent image carrying member due to transfer failure, so as to maintain high quality in image formation for a long period of time.

According to a first aspect of the invention, a developer for developing an electrostatic latent image, includes a carrier; and a toner including an external additive. The carrier has a median of an arithmetic average height distribution of from 0.45 to 0.65 μm. The toner has an average circularity of 0.975 or more. The circularity is defined by:

$$\text{(Circularity)} = \text{(peripheral length of equivalent circle diameter)}/\text{(Peripheral length)} = (2\times(A\pi)^{1/2})/PM$$

where A represents a projected area of a particle, and PM represents a peripheral length of a particle.

According to a second aspect of the invention, a cleaner-less image forming method includes forming an electrostatic latent image on a electrostatic latent image carrying member; developing the electrostatic latent image with a developer comprising a toner and a carrier to form a toner image; and transferring the toner image, in which the carrier has a median of an arithmetic average height distribution of from 0.45 to 0.65 μm, and the toner includes an external additive and has an average circularity of 0.975 or more, and the circularity is defined by:

$$\text{(Circularity)} = \text{(peripheral length of equivalent circle diameter)}/\text{(Peripheral length)} = (2\times(A\pi)^{1/2})/PM$$

where A represents a projected area of a particle, and PM represents a peripheral length of a particle.

According to a method for forming an image of the invention, in a method for forming an image using no blade cleaning unit accelerating abrasion of an electrophotographic photoreceptor, i.e., an electrostatic latent image carrying member, a residual toner and a discharge products, which cause image quality deterioration, such as white dropout and image blur, can be effectively removed. As a result, such a method for forming an image can be provided that maintains good image quality for a long period of time.

DETAILED DESCRIPTION OF THE PREFERRED EMBODIMENTS

Image Forming Method

A cleaner-less image forming method of the invention contains steps of: forming an electrostatic latent image on an electrostatic latent image carrying member; developing the electrostatic latent image with a developer containing a toner to form a toner image; transferring the toner image; and fixing the toner image thus transferred, but contains no cleaning step for removing a toner remaining on the electrostatic latent image carrying member after transferring. These process steps may be those known in the art and disclosed, for example, in JP-A-56-40868 and JP-A-49-91231. The method for forming an image of the invention may be practiced a known image forming apparatus, such as a duplicator and a facsimile machine, that has no cleaning step.

The step of forming an electrostatic latent image is to form an electrostatic latent image on an electrostatic latent image carrying member, and the step of forming a toner image is to develop the electrostatic latent image with a developer on a developer carrying member to form a toner image. The step of transferring is to transfer the toner image to a transfer material, and examples of the transfer material include a fixing substrate, such as paper, and an intermediate roll. The step of fixing is to fix the toner image thus transferred to the fixing substrate by heating with a fixing member.

The method for forming an image of the invention does not has a cleaning step for removing the toner remaining on the electrostatic latent image carrying member.

In the fixing step, the toner image on the fixing substrate, such as paper, is fixed by heat fusing by passing the fixing substrate between two fixing members. The fixing members may have a roll form or a belt form, and at least one thereof has a heating device. The fixing member may be a roll or a belt as it is or may be coated with a resin on the surface thereof.

The fixing roll may be produced by coating silicone rubber or VITON rubber on a surface of a core material.

The fixing belt may be formed with a material, such as polyamide, polyimide, polyethylene terephthalate and polybutylene terephthalate, which may be used solely or as a mixture of two or more kinds thereof. Examples of the coated resin of the roll or belt include a homopolymer of or a copolymer of two or more of a styrene compound, such as styrene, p-chlorostyrene and α-methylstyrene, an aliphatic α-methylene carboxylate compound, such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, a nitrogen-containing acrylic compound, such as dimethylaminoethyl methacrylate, a vinylnitrile compound, such as acrylonitrile and methacrylonitrile, a vinylpyridine compound, such as 2-vinylpyridine and 4-vinylpyridine, a vinyl ether compound, such as vinyl methyl ether and vinyl isobutyl ether, a vinyl ketone compound, such as vinyl methyl ketone, vinyl ethyl ketone and vinyl isopropenyl ketone, an olefin compound, such as ethylene and propylene, and a fluorine-containing vinyl monomer, such as vinylidene fluoride, tetrafluoroethylene and hexafluoropropylene, a silicone compound, such as methylsilicone and methylphenylsilicone, a polyester compound containing bisphenol, glycol and the like, an epoxy resin, a polyurethane resin, a polyamide resin, a cellulose resin, a polyether resin and a polycarbonate resin. These resins may be used solely or in combination of two or more kinds thereof. Specific examples thereof include a homopolymer or a copolymer of a fluorine-containing compound, such as polytetrafluoroethylene, vinylidene fluoride and ethylene fluoride, and a homopolymer or a copolymer of an unsaturated hydrocarbon compound, such as ethylene and propylene.

Examples of the fixing substrate for fixing the toner thereon include paper and a resin film. Examples of the fixing paper include coated paper having a resin coated on the whole or a part of the surface thereof. Examples of the resin film for fixing include a resin coated film having another kind of resin coated on the whole or a part of the surface thereof. Resin particles or inorganic particles may be added to the fixing substrate for preventing duplicated feed of the fixing substrate due to friction of the paper or resin film or due to electrostatic charge caused by the friction, and for preventing deterioration in adhesion of the fixed image due to elution of the releasing agent to the interface between the fixing substrate and the fixed image upon fixing.

Examples of the resin coated on the paper or resin film include a homopolymer of or a copolymer of two or more of a styrene compound, such as styrene, p-chlorostyrene and α-methylstyrene, an aliphatic α-methylene carboxylate compound, such as methyl acrylate, ethyl acrylate, n-propyl acrylate, lauryl acrylate, 2-ethylhexyl acrylate, methyl methacrylate, n-propyl methacrylate, lauryl methacrylate and 2-ethylhexyl methacrylate, a nitrogen-containing acrylic compound, such as dimethylaminoethyl methacrylate, a vinylnitrile compound, such as acrylonitrile and methacrylonitrile, a vinylpyridine compound, such as 2-vinylpyridine and 4-vinylpyridine, a vinyl ether compound, such as vinyl methyl ether and vinyl isobutyl ether, a vinyl ketone compound, such as vinyl methyl ketone, vinyl ethyl ketone and vinyl isopropenyl ketone, an olefin compound, such as ethylene and propylene, and a fluorine-containing vinyl monomer, such as vinylidene fluoride, tetrafluoroethylene and hexafluoropropylene, a silicone compound, such as methylsilicone and methylphenylsilicone, a polyester compound containing bisphenol, glycol and the like, an epoxy resin, a polyurethane resin, a polyamide resin, a cellulose resin, a polyether resin and a polycarbonate resin. These resins may be used solely or in combination of two or more kinds thereof.

Examples of the inorganic particles include those particles that have been used as an external additive for the toner surface, such as silica, titania, calcium carbonate, magnesium carbonate, tricalcium phosphate and cerium oxide. Examples of the resin particles include those particles that have been used as an external additive for the toner surface, such as a vinyl resin, a polyester resin and a silicone resin. These inorganic particles and organic particles may also be used as a fluidizing assistant.

In the method for forming an image of the invention, a developer for developing an electrostatic latent image containing a carrier for developing an electrostatic latent image and a toner is used in the developing step, in which the carrier has a median of an arithmetic average height (Ra) distribution of from 0.45 to 0.65 μm, and the toner contains coloring particles containing a binder resin, a coloring agent and a releasing agent, and an external additive, and has an average circularity of 0.975 or more.

The developer for developing an electrostatic latent image will be described in more detail below.

(Developer for Developing Electrostatic Latent Image)

The developer for developing an electrostatic latent image in the invention contains a carrier for developing an electrostatic latent image and a toner. The carrier for developing an electrostatic latent image (hereinafter, sometimes simply referred to as a "carrier") of the invention has a median of an arithmetic average height distribution of from 0.45 to 0.65 μm. The toner for developing an electrostatic latent image (hereinafter, sometimes simply referred to as a "toner") of the invention contains coloring particles containing a binder resin, a coloring agent and a releasing agent, and an external additive, and has an average circularity of 0.975 or more.

The developer for developing an electrostatic latent image of the invention is preferably prepared by mixing from 3 to 15 parts by weight (by mass) of the toner for developing an electrostatic latent image of the invention described later with 100 parts by weight of the carrier described later, and more preferably mixing from 3 to 12 parts by weight of the toner with 100 parts by weight of the carrier.

The carrier and the toner for developing an electrostatic latent image will be described below.

(Carrier)

The carrier for developing an electrostatic latent image (hereinafter, sometimes simply referred to as a "carrier") of the invention has a median of an arithmetic average height (Ra) distribution of from 0.45 to 0.65 μm.

The arithmetic average height of the carrier herein is an index of surface roughness, which is a physical value generally represented by Ra.

The value Ra is obtained in such a manner that the roughness curve of the carrier surface is extracted in the standard length in the average line direction, and absolute values of deviations from the average line of the extracted part to the measured curve are summed up and averaged out. A smaller value means a smooth surface, and a larger value means a roughened surface.

The arithmetic average height of the carrier can be obtained in such a manner that plural carriers are used as samples, the surface of the particles thereof are irradiated with laser light, and the minute irregular structures on the surfaces of the samples are analyzed from the reflected light.

For example, a color laser three-dimensional profile microscope (VK-9500, produced by Keyence Corp.) may be used for the analysis. In this apparatus, a sample is irradiated with laser light by three-dimensional scanning. The reflected laser light is monitored with a CCD camera by positions to obtain three-dimensional surface information of the sample. The surface information thus obtained is statistically processed to obtain a characteristic value relating to the surface roughness.

In the invention, 240 of the carrier particles are repeatedly measured to obtain the arithmetic average height distribution of the carrier, and the data thus obtained is statistically processed to obtain statistical values of the arithmetic average height of the carrier, such as an average value, a median and a standard deviation. The fluctuation of the arithmetic average height referred herein means a percentage value of the standard deviation of the arithmetic average height with respect to the average value.

The median of the arithmetic average height distribution of the surface of the carrier thus obtained is controlled to a value of from 0.45 to 0.65 μm, and more preferably from 0.50 to 0.60 μm, whereby a discharge product formed on the surface of the electrostatic latent image carrying member and a remaining residual toner fixed thereon can be effectively scraped at the developing nip part to maintain the surface of the carrying member to a clean state. In the case where the median of the arithmetic average height distribution is less than 0.45 μm, the scraping power is insufficient, and in the case where it exceeds 0.65 μm, the surface of the carrying member is abraded to cause surface deterioration although the scraping power is sufficient.

The fluctuation of the arithmetic average height on the surface of the carrier is preferably 40 or more to form a carrier having large irregularity, which effectively exerts the scraping effect.

The surface of the carrier preferably has a 90% cumulative frequency value of an arithmetic average height distribution (hereinafter, sometimes simply referred to as an accumulation) of 0.8 μm or more, whereby fixed toner particles can be effectively scraped and removed.

The carrier for developing an electrostatic latent image of the invention may be either a coated carrier containing a core material having a resin coated layer or a non-coated carrier, and a coated carrier is preferred from the standpoint of charging characteristics and maintenance characteristics.

The coated carrier contains magnetic particles as a carrier core material, and a matrix resin as a coating material. In other words, the coated carrier is obtained by coating the surface of the carrier core with a raw material solution for forming the resin coated layer.

The core material of the coated carrier may be at least one kind selected from known core materials, such as iron particles, ferrite particles and magnetite particles, and may be selected depending on the hardware conditions of the target developing device, and ferrite particles are preferably used.

The core particles preferably have a volume average particle diameter of from 10 to 55 μm. In the case where the volume average particle diameter is in the range, the coated layer is not released due to stress inside the developing device, and thus the carrier resistance is not lowered. It is also preferred since no toner impaction occurs to prevent the carrier resistance from being increased. It is expected that these phenomena are caused by the weight per one carrier particle.

The magnetic particles used as the core material preferably has such a magnetic force that provides a saturation magnetization of 50 $A \cdot m^2/kg$ (emu/g) or more, and more preferably 60 $A \cdot m^2/kg$ (emu/g) or more, at 3,000 Oe. In the case where saturation magnetization is 50 $A \cdot m^2/kg$ (emu/g) or more, it is preferred since the carrier is not developed on the photoreceptor along with the toner.

The matrix resin may be selected from arbitrary resins that have been utilized as a coated layer of a carrier in this field of art, and may be used solely or in combination of two or more kinds thereof. The matrix resin is preferably a charge imparting resin for imparting charging property to the toner, and a low surface energy material for preventing the toner components from being transferred to the carrier. The matrix resin may contain resin particles for the coated layer or electroconductive powder for adjusting the charge and the resistance.

Examples of the charge imparting resin that imparts negative charge to the toner include an amino resin, such as a urea-formaldehyde resin, a melamine resin, a benzoguanamine resin, a urea resin and a polyamide resin, and an epoxy resin, and examples thereof also include a polyvinyl or polyvinylidene resin, an acrylic resin, a polymethyl methacrylate resin, a polyacrylonitrile resin, a polyvinyl acetate resin, a polyvinyl alcohol resin, a polyvinyl butyral resin, and a cellulose resin, such as an ethylcellulose resin. Examples of the charge imparting resin that imparts positive charge to the toner include a polystyrene resin, a polystyrene copolymer resin, such as a styrene-acrylic copolymer resin, a halogenated olefin resin, such as polyvinyl chloride, a polyester resin, such as a polyethylene terephthalate resin and a polybutyrene terephthalate resin, and a polycarbonate resin.

Examples of the low surface energy material for preventing the toner components from being transferred to the carrier include a polystyrene resin, a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, a fluoroterpolymer, such as a terpolymer of tetrafluoroethylene, vinylidene fluoride and a non-fluorine monomer, and a silicone resin.

Examples of the electroconductive powder include metallic powder, carbon black, titanium oxide, tin oxide and zinc oxide. The electroconductive powder preferably has an average particle diameter of 1 μm or less. In the case where the average particle diameter thereof is 1 μm or less, the electric resistance can be easily controlled. The electroconductivity of the electroconductive powder itself is preferably 1010 Ω·cm or less, and more preferably $10^9$ Ω·cm or less. An electroconductive resin may be used in combination depending on necessity.

The content of the electroconductive powder in the resin coated layer is preferably from 0.05 to 10% by weight, and more preferably from 0.10 to 5.0% by weight. In the case where the content thereof is in the range, the carrier resistance is not lowered, and image defects due to adhesion of the carrier to the developed image can be prevented. Furthermore, the electroconductivity of the carrier can be suitably controlled, whereby no edge effect occurs in a black solid part upon development to provide excellent reproducibility of a solid image.

The resin particles for the coated layer preferably have a particle diameter of from 0.1 to 2.0 μm, and more preferably from 0.2 to 1.0 μm. In the case where the particle diameter thereof is in the range, dispersion property in the coated layer is improved to provide a firm coated layer. Furthermore, the coated layer is difficult to be released to maintain the primary function thereof. In order to impart negative charging property to the toner, the resin particles for the coated layer preferably contain a nitrogen atom having electron donating property as a constitutional component thereof.

The resin particles for the coated layer may be either a thermoplastic resin or a thermosetting resin.

Specific examples of the thermoplastic resin include a polyolefin resin, such as polyethylene and polypropylene; a polyvinyl or polyvinylidene resin, such as polystyrene, an acrylic resin, polyacrylonitrile, polyvinyl acetate, polyvinyl alcohol, polyvinyl butyral, polyvinyl chloride, polyvinyl carbazole, polyvinyl ether and polyvinyl ketone; a vinyl chloride-vinyl acetate copolymer; a styrene-acrylic acid copolymer; a straight silicone resin formed with an organosiloxane bond and a modified product thereof; a fluorine resin, such as polytetrafluoroethylene, polyvinyl fluoride, polyvinylidene fluoride and polychlorotrifluoroethylene; polyester; and polycarbonate.

Examples of the thermosetting resin include a phenol resin; an amino resin, such as a urea-formaldehyde resin, a melamine resin, a benzoguanamine resin, a urea resin and a polyamide resin; and an epoxy resin.

The content of the resin particles for the coated layer in the resin coated layer is preferably from 0.05 to 3.0% by weight, and more preferably from 0.1 to 2.0% by weight. In the case where the content thereof is in the range, the resin coated layer has a favorable strength to prevent the carrier coated layer from being released due to stress inside the developing device. Furthermore, good charging property can be obtained.

The method for controlling the arithmetic average height (Ra) distribution on the surface of the carrier in the invention can be roughly classified into two methods.

One method is to control the surface property in the stage where the core particles are produced. For example, ferrite particles for the core material can be produced in the following manner. A metallic oxide having been sized to 10 μm or less is mixed in a HENSCHEL mixer and calcined at 900° C. for 3 hours. Powder thus produced through a semi-spinel reaction by the calcination is mixed with water and pulverized in a ball mill for 10 hours. A binder (polyvinyl alcohol) and several percents of a dispersant are added to the resulting aqueous dispersion liquid to obtain a slurry. The slurry is formed into particles by a spray dryer method or a fluidized granulation method, followed by drying, and the resulting granulated pellets are sintered in an electric furnace, a rotary kiln or a batch sintering furnace at a temperature of from 1,100 to 1,500° C., and more preferably from 1,200 to 1,400° C. The particles are then classified by sieving to control the particle size distribution, and thus the core particles for the carrier are completed. While recessed parts are formed on the joint interface of the primary particles due to crystal growth of the primary particles upon calcination, such core particles can be obtained that are adjusted in surface irregularity by controlling various conditions including the property of the raw materials, the additives, the calcination conditions, the sintering conditions and the pulverization conditions. In the case where the sintering temperature is increased, in particular, the shape of the particles is close to a spherical shape to obtain a core material having a smooth surface property (i.e., a small average value of the arithmetic average height).

The ferrite particles used herein can be represented by the following formula (1).

$$(MO)_{100-x}(Fe_2O_3)_x \quad (1)$$

wherein M represents at least one metal selected from the group consisting of Li, Mg, Ca, Zn, Cu and Mn, and x represents from 45 to 95% by mole.

The ratio of an oxide of at least one metal selected from the group consisting of Li, Mg, Ca, Zn, Cu and Mn and $Fe_2O_3$ in the ferrite components is preferably from 5/95 to 55/45, and more preferably from 35/65 to 55/45, in terms of % by mole. In the case where the ratio is in the range, non-reacted substances for the ferrite are not deposited to prevent shortage in magnetic susceptibility.

The ferrite particles for the core material preferably satisfy the aforementioned conditions in terms of ferrite components and is preferably added with a small amount of another metallic oxide for controlling the crystal growth rate and the irregularity on the surface of the particles or for controlling the particle density. Examples of the metallic oxide include oxide of at least one element selected from IIIB Group elements, Si, Sn and VB Group elements, such as $Al_2O_3$, SiO, $SnO_2$ and $Bi_2O_5$. The addition amount of the metallic oxide other than the ferrite components is preferably from 0.01 to 10 parts by weight, and more preferably from 0.05 to 5 parts by weight, per 100 parts by weight of the ferrite components. In the case where the content is in the range, a favorable crystal growth rate can be obtained, and the porosity inside the core material is decreased to suppress impregnation of the coating resin, which facilitate coating of the resin, whereby a high sintering temperature can be avoided. Furthermore, the uniformity in composition can be obtained to suppress formation of oxides other than the ferrite composition and to suppress formation of non-magnetic materials or feebly-magnetic materials due to reaction of the oxide and hematite, and as a result, the carrier is prevented from being attached to the photoreceptor.

The matrix resin is then coated, depending on necessity, on the core material thus obtained to obtain the desired carrier. The arithmetic average height distribution of the carrier core particles herein does not always agree with the arithmetic average height distribution of the resulting carrier.

The other method for controlling the arithmetic average height (Ra) distribution on the surface of the carrier is to change the coated amount of the matrix resin. This method utilizes such a phenomenon that upon coating the matrix resin on the core material having surface irregularity, the resin is preferentially coated on the recessed parts. According to the method, the arithmetic average height distribution on the surface of the carrier can be continuously controlled by increasing the coated amount of the resin up to the arithmetic average height distribution of the core particles as the upper limit.

Examples of the practical coating method for coating the matrix resin on the carrier material include a spray dry method, in which a raw material solution for forming a resin coated layer is sprayed on the surface of the core material, followed by removing a solvent, a kneader-coater method, in which the core material and a raw material solution for forming a resin coated layer are mixed in a kneader-coater, followed by removing a solvent, a dipping method, in which the core material is dipped in a raw material solution for forming a resin coated layer, and a fluidized bed method, in which a raw material solution for forming a resin coated layer is sprayed on the core material in a state of being floated with fluidizing air.

(Toner)

The toner for developing an electrostatic latent image (hereinafter, sometimes simply referred to as a toner) used in the invention contains at least coloring particles containing a binder resin, a coloring agent and a releasing agent, and an external additive, and has an average circularity of 0.975 or more.

The toner for developing an electrostatic latent image of the invention contains at least coloring particles containing a binder resin, a coloring agent and a releasing agent, and an external additive, and depending on necessity, contains other components. The components will be described in detail later.

The toner in the invention has an average circularity of 0.975 or more, and more preferably 0.980 or more. The fluctuation of the circularity of the toner is preferably 0.25 or less, and more preferably 0.20 or less.

The average circularity referred herein is a value obtained in such a manner that a certain number of toner particles are subjected to image analysis to obtain circularities of the respective toner particles thus pictured according to the following expression, and the circularities thus obtained are averaged to obtain the average circularity. The fluctuation of the circularity is a value obtained in such a manner that the circularities of the respective toner particles are statistically processed to obtain a percentage value of the standard deviation of the circularity with respect to the average value.

$$\text{(Circularity)} = \text{(peripheral length of equivalent circle diameter)} / \text{(Peripheral length)} = (2 \times (A\pi)^{1/2}) / PM$$

wherein A represents a projected area of the particle, and PM represents a peripheral length of the particle.

An average circularity of 1.0 means a true sphere, and in the case where the average circularity is decreased, the surface irregularity is increased. The toner of the invention has an average circularity of 0.975 or more and thus is a so-called spherical toner, whereby the remaining toner amount upon transferring is reduced to attain high transfer efficiency, and the toner is prevented from being fixed on the electrostatic latent image carrying member. In the case where the average circularity is less than 0.975, the toner has large irregularity and thus has a large surface area. The large surface area increases the electrostatic adhering force, which significantly deteriorate the transfer efficiency. The large irregularity brings about such a phenomenon that the external additive is buried on the recessed parts on the surface of the toner, whereby the functions of the external additive (i.e., implementation of charge and spacer effect) are substantially impaired. Consequently, high transfer efficiency is difficult to be attained due to these factors.

In the case where the fluctuation of the circularity of the toner is more than 0.25, it is preferred since the distribution of the toner shape is small, and thus the state of attachment of the external additive on the respective toner particles is uniform. The state of attachment of the external additive is preferably uniform since it also makes the charging amount uniform, whereby highly effective transferring can be simultaneously attained with only one kind of transferring conditions.

The surface of the toner of the invention preferably has a median of an arithmetic average height distribution of from 0.05 to 0.12 μm and a fluctuation of the arithmetic average height of 25 or more, and more preferably from 25 to 35. The aforementioned ranges makes the surface minute irregular structure small and uniform, and uniform charging of the toner and uniform spacer effect of the external additive are attained, whereby further higher transfer efficiency can be attained.

The median of an arithmetic average height distribution and the fluctuation of the toner surface are obtained in the same manner as in the median of an arithmetic average height distribution and the fluctuation of the carrier surface.

The toner of the invention preferably has a number average particle diameter DTN of from 5.0 to 7.0 μm, and more preferably from 5.5 to 6.5 μm. In the case where the number average particle diameter DTN is in the range, the surface area of the toner is not too large to prevent the electrostatic adhesion force from being increased, whereby the transfer efficiency is not lowered. Furthermore, the toner is difficult to scatter in the developing and transferring steps to prevent the reproducibility of the electrostatic latent image from being deteriorated, whereby high image quality can be obtained.

The aforementioned range of the number average particle diameter is also preferred since excellent color reproducibility can be obtained upon forming a full color image.

The fluctuation of the number average particle diameter of the toner of the invention is preferably 25 or less, and more preferably 20 or less. In the case where the fluctuation of the number average particle diameter is too large, the difference in size between the coloring particles with small diameters and the coloring particles with large diameters is increased. The large difference in size provides a large difference in surface area per one toner particle. The surface charge density of the toner in the developing device corresponds to the surface area, and therefore, the difference in surface area per one toner particle may bring about a difference in charging amount per one toner particle.

Therefore, in the case where the fluctuation of the number average particle diameter of the toner is in the aforementioned range, it is preferred since the difference in charging amount per one toner particle is not too large. In the case where the difference in charging amount is small, the optimum transfer electric field for the respective toner particles becomes uniform, whereby highly effective transferring can be simultaneously attained with only one kind of transferring conditions.

The fluctuation of the number average particle diameter is a value obtained in such a manner that the number average particle diameters DTN measured for the respective toner particles are statistically processed to obtain a percentage value of the standard deviation thereof with respect to the average value. Specific measuring method therefor will be described later.

The number average particle diameter, the fluctuation of the number average particle diameter, the average circularity, and the fluctuation of the circularity of the toner can be obtained by statistically processing results of image analysis of at least 5,000 toner particles obtained by using a flow type particle image analyzer, FPIA-2100 (produced by Sysmex Corp.).

A production process of the coloring particles in the invention will be described.

The coloring particles in the invention can be produced by a kneading and pulverizing method and a chemical method, such as emulsion polymerization and suspension polymerization, which have been known in the art. It is preferred that the toner of the invention is produced by emulsion polymerization since a toner excellent in particle size distribution and shape distribution in the invention can be produced, and good results can be obtained in yield and environmental load.

Accordingly, the production process using emulsion polymerization will be described herein.

In the emulsion polymerization method, a binder resin dispersion liquid using an ionic surfactant and a coloring agent dispersion liquid using another ionic surfactant having opposite polarity are mixed to form aggregated particles having a toner particle diameter through occurrence of hetero aggregation (aggregating step), and then the aggregated particles are heated to a temperature higher than the glass transition point of the resin to integrate the aggregated particles (integrating step), followed by washing and drying, to obtain a toner.

In this method, not only the toner shape can be controlled from an irregular shape to a spherical shape, but also the arithmetic average height of the coloring particles can be controlled, by selecting the heating temperature conditions. Even in the case where the coloring agent particles and the binder resin particles have the same polarity, the aggregated particles can be similarly formed by using a surfactant having an opposite polarity. Furthermore, a layer structure from the surface to the interior of the toner particles can be controlled in such a manner that, before heating the aggregated particle dispersion liquid to integrate the aggregated particles, a dispersion liquid of other particles (adhering particles) is added to attach the particles on the surface of the aggregated particles, and the aggregated particles are heated to a temperature higher than the glass transition point of the resin. According to the procedure, furthermore, the surface of the toner particles can be coated with a binder resin or a charge controlling agent, and a releasing agent or a coloring agent can be disposed in the vicinity of the toner surface.

What is important upon controlling the particle size distribution, the shape distribution and the arithmetic average height is that the particles (adhering particles) of the particle dispersion liquid added later are uniformly and firmly attached to the surface of the aggregated particles. In the case where the adhering particles are present in a floating state or are once adhered but then released, the particle size distribution and the shape distribution are readily broadened, and the arithmetic average height is also changed. In the case where the particle size distribution is broadened, and particularly in the case where the toner particles are particles, the toner particles are firmly fixed on the photoreceptor upon developing to cause black spots. As a result, in the two-component developer, contamination of the carrier is liable to occur to shorten the service life of the developer, and in the one-component developer, the toner particles are fixed on a developing roll, a charging roll and a trimming roll or blade to contaminate them, which causes deterioration in image quality. Furthermore, there is a significant factor of deteriorating image quality and reliability in particle diameter distribution in the toner particles.

Upon producing the toner by the emulsion polymerization method, it is important to control the stirring conditions for the particle diameter distribution and the shape distribution. Since the viscosity of the dispersion liquid is increased upon forming the aggregated particles as mother particles or after adding the adhering particles, the amount of the aggregated particles attached to a wall of a reaction vessel or a stirring blade is increased upon stirring the dispersion liquid at a high shearing velocity by using a stirring blade of a tilted paddle type for uniform mixing, whereby the particle diameter is impaired from becoming uniform. In order to stir uniformly with a low sharing velocity, a stirring blade having a blade shape with large width in the liquid depth direction (flat blade) is effectively used.

It is also effective that coarse particles are removed by filtering the dispersion liquid by using a filter bag having an aperture of 10 μm after forming the aggregated particles. It is effective that filtration is carried out in multi-stage or repeatedly depending on necessity. The influence of the particle size distribution and the shape distribution is increased in the case where the toner has a small average particle diameter or has a shape close to a spherical shape.

In the aggregating and integrating steps, generally, the dispersion liquids are mixed and aggregated at a time, whereby the aggregated particles can be integrated in a uniform mixed state, and thus the toner has a uniform composition from the surface to the interior thereof. In the case where the releasing agent is contained by the aforementioned manner, the releasing agent is present on the surface after integrating, which is liable to cause such a phenomenon that filming occurs, and an external additive for imparting flowability is buried within the toner particles.

In view of the aforementioned circumstances, the following measure can be employed. The balance of the amounts of the ionic surfactants of opposite polarities is deviated in the aggregating step, and the mother aggregated particles of the first step is formed and stabilized at a temperature lower than the glass transition point. Thereafter, as the second step, a dispersion liquid of particles (adhering particles) is added thereto in such a polarity and an amount that compensate the deviation of the balance. Furthermore, depending on necessity, the dispersion liquid is stabilized by slightly heating to a temperature lower than the glass transition points of the resins contained in the mother aggregated particles and the additional particles, and then the dispersion liquid is heated to a temperature higher than the glass transition point to integrate the aggregated particles in such a state that the particles added in the second step are attached to the surface of the mother aggregated particles. The aggregating operations herein may be repeated stepwise in plural times, and as a result, the composition and the physical properties of the toner particles can be changed from the surface to the interior thereof, whereby the toner structure can be easily controlled.

For example, in the case of a color toner used for multicolor development, mother particles are produced by using binder resin particles and coloring agent particles in the first step, and then another dispersion liquid of a binder resin particles is added thereto to form a layer containing only the resin on the toner surface, whereby the influence of the coloring agent particles on the charging behavior can be minimized. As a result, the difference in charging characteristics depending on the species of the coloring agents can be suppressed. In the case where the glass transition point of the binder resin added in the second step is set at a relatively high value, the toner particles can be coated in a capsule form, whereby both the thermal stability and the fixing property can be attained.

Furthermore, in the case where a dispersion liquid of particles of a releasing agent, such as wax, is added in the second step, and then a shell is formed on the outermost surface by using a dispersion liquid of a binder resin having higher hardness in the third step, the wax can be suppressed from being exposed to the toner surface, but the wax can effectively function as a releasing agent upon fixing.

It is also possible that after adding particles of a releasing agent to the mother aggregated particles, a shell is formed on the outermost surface in the second step to prevent wax from being exposed. In the case where the wax is prevented from being exposed, not only filming to the photoreceptor or the like is suppressed, but also the powder flowability of the toner can be improved.

As having been described, in the method where particles (such as binder resin particles and releasing agent particles) are attached stepwise to the surface of the aggregated particles and then integrated by heating, the maintenance property of the particle size distribution and the shape distribution can be controlled, and fluctuation in average particle diameter and circularity can be suppressed. Furthermore, addition of a surfactant and a stabilizer, such as a base and an acid, for improving the stability of the aggregated particles can be omitted, or the addition amounts thereof can be suppressed to minimum.

The dispersed diameter of the dispersed particles is preferably 1 μm or less in both the cases where they are used in the mother aggregated particles or used as the additional particles. In the case where the diameter exceeds 1 μm, the particle size distribution of the toner finally obtained is broadened, and free particles are formed, which may cause deterioration in capability and reliability of the toner.

The amount of the particle dispersion liquid to be added depends on the volume fraction thereof contained in the mother aggregated particles, and the amount of the additional particles is preferably adjusted to 50% by volume or less based on the aggregated particles finally formed. In the case where the amount is 50% by volume or less, it is preferred since the additional particles are attached to the mother aggregated particles but form no other aggregated particles. Furthermore, the compositional distribution and the particle diameter distribution can be narrowed to obtain desired performance.

Furthermore, the particle dispersion liquid may be added divisively or stepwise or may be gradually added continuously, which is effective for suppressing formation of minute aggregated particles to sharpen the particle diameter distribution and the shape distribution. Moreover, upon adding the particle dispersion liquid, the dispersion liquids may be heated to a temperature lower than the glass transition temperature of the binder resins of the mother aggregated particles and the additional particles, and preferably from a temperature lower than the glass transition temperature by 40° C. to the glass transition temperature, whereby formation of free particles can be suppressed.

(Binder Resin)

Examples of the thermoplastic resin used as the binder resin of the toner of the invention include a homopolymer of or a copolymer of two or more of a styrene compound, such as styrene, p-chlorostyrene and α-methylstyrene, an ester compound having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate, a vinylnitrile compound, such as acrylonitrile and methacrylonitrile, a vinyl ether compound, such as vinyl methyl ether and vinyl isobutyl ether, a vinyl ketone compound, such as vinyl methyl ketone, vinyl ethyl ketone and vinyl isopropenyl ketone, and an olefin compound, such as ethylene, propylene and butadiene, mixtures thereof, an epoxy resin, a polyester resin, a polyurethane resin, a polyamide resin, a cellulose resin, a polyether resin, a non-vinyl condensation resin and mixtures thereof with the vinyl resin, and a graft polymer obtained by polymerizing a vinyl monomer in the presence of the non-vinyl condensation resin. These resins may be used solely or in combination of two or more kinds thereof.

In the case where the vinyl monomer is used among these, a resin particle dispersion liquid can be produced by carrying out emulsion polymerization or seed polymerization by using an ionic surfactant, and in the case where the other resins are used, the resin is dissolved in an oily solvent having relatively low solubility in water, and the solution is dispersed into particles in water by using a dispersing device, such as a homogenizer, in the presence of an ionic surfactant or a polymer electrolyte, followed by evaporating the solvent by heating or reducing the pressure, so as to obtain the target resin particle dispersion liquid.

The thermoplastic binder resin can be produced stably in the form of particles by mixing a dissociative vinyl monomer through emulsion polymerization. Examples of the dissociative vinyl monomer include those monomers that are raw materials of a polymer acid and a polymer base, such as acrylic acid, methacrylic acid, maleic acid, cinnamic acid, fumaric acid, vinylsulfonic acid, ethyleneimine, vinylpyridine and vinylamine. From the standpoint of easiness of the polymer formation reaction, a monomer forming a polymer acid is preferred, and a dissociative vinyl monomer having a carboxylic acid, such as acrylic acid, methacrylic acid, maleic acid, cinnamic acid and fumaric acid, is particularly effective for controlling the polymerization degree and the glass transition point.

The binder resin particles preferably have an average particle diameter of 1 μm or less, and more preferably in a range of from 0.01 to 1 μm. In the case where the average particle diameter of the binder resin particles is in the range, such advantages can be obtained that maldistribution among the toner particles can be prevented, and the particles are favorably dispersed in the toner, whereby fluctuation in performance and reliability can be suppressed. The average particle diameter of the binder resin particles can be measured, for example, by using a MICROTRAC particle size analyzer.

(Releasing Agent)

Examples of the releasing agent in the invention include a low molecular weight polyolefin, such as polyethylene, polypropylene and polybutene; a silicone having a softening point upon heating; an aliphatic amide compound, such as oleic amide, erucic amide, recinoleic amide and stearic amide; vegetable wax, such as ester wax, carnauba wax, rice wax, candelilla wax, haze wax and jojoba oil; animal wax, such as beeswax; mineral or petroleum wax, such as montan wax, ozokerite, ceresin, paraffin wax, microcrystalline wax and Fischer-Tropsch wax; and modified products thereof. These kinds of wax are dispersed in water along with an ionic surfactant or a polymer electrolyte, such as a polymer acid and a polymer base, and dispersed into particles by using a homogenizer or a pressure discharge dispersing device capable of applying a strong shearing force under heating, so as to produce a dispersion liquid containing particles having a diameter of 1 μm or less.

The releasing agent particles preferably have an average particle diameter of 1 μm or less, and more preferably in a range of from 0.01 to 1 μm. In the case where the average particle diameter of the releasing agent particles is in the range, such advantages can be obtained that maldistribution among the toner particles can be prevented, and the particles are favorably dispersed in the toner, whereby fluctuation in performance and reliability can be suppressed. The average particle diameter of the releasing agent particles can be measured, for example, by using a MICROTRAC particle size analyzer.

(Coloring Agent)

Examples of the coloring agent in the invention include various pigments, such as carbon black, Chrome Yellow, Hansa Yellow, Benzidine Yellow, Threne Yellow, Quinoline Yellow, Permanent Orange GTR, Pyrazolone Orange, Vulkan Orange, Watchyoung Red, Permanent Red, Brilliant Carmine 3B, Brilliant Carmine 6B, Du Pont Oil Red, Pyrazolone Red, Lithol Red, Rhodamine B Lake, Lake Red C, Rose Bengal, Aniline Blue, Ultramarine Blue, Calco Oil Blue, Methylene Blue Chloride, Phthalocyanine Blue, Phthalocyanine Green and Malachite Green Oxalate, and various kinds of dyes, such as an acridine series, a xanthene series, an azo series, a benzoquinone series, an azine series, an anthraquinone series, a thioindigo series, a dioxadine series, a thiazine series, an azomethine series, an indigo series, a phthalocyanine series, an aniline black series, a polymethine series, a triphenylmethane series, a diphenylmethane series and a thiazole series, which may be used solely or as a mixture of two or more kinds thereof.

The coloring agent particles in the invention preferably have an average particle diameter of 0.8 μm or less, and more preferably from 0.05 to 0.5 μm. In the case where the average particle diameter of the coloring agent particles is in the range, the toner for developing an electrostatic latent image finally obtained has a particle diameter distribution and a shape distribution that are in suitable ranges, and free particles are suppressed from being formed to prevent compositional maldistribution of the toner, whereby good performance and reliability can be obtained. Furthermore, the coloring property of the toner and the shape controlling property of the toner, which is one of the characteristic features of the emulsification and aggregation process, are improved to facilitate formation of a toner having a shape close to a true sphere.

Furthermore, a charge controlling agent may be used depending on necessity, and examples of the charge controlling agent include various kinds of charge controlling agents having been generally used, such as a quaternary ammonium salt, a nigrosine compound, a dye containing a complex of aluminum, iron or chromium, and triphenylmethane pigment. A charge controlling agent that is hardly soluble in water is preferred for controlling the ion strength, which influences on the stability upon aggregation and integration, and for reducing the amount of waste water.

Examples of the surfactant used upon seed polymerization, dispersion of the coloring agent, dispersion of the binder resin particles, dispersion of the releasing agent, aggregation and stabilization include an anionic surfactant, such as a sulfate ester series, a sulfonate ester series, a phosphate ester series and a soap series, and a cationic surfactant, such as an amine salt type and a quaternary ammonium salt type, and it is preferred to use, in combination therewith, a nonionic surfactant, such as a polyethylene glycol series, an alkylphenol ethylene oxide adduct series and a polyhydric alcohol series. Examples of the dispersing device include various dispersion devices having been generally used, such as a rotation shearing homogenizer and a media mill, e.g., a ball mill, a sand mill and a Dinor mill.

In the case where a composite material containing a binder resin and a coloring agent, such a method may be employed that the binder resin and the coloring agent are dispersed in a suitable solvent, and further dispersed along with a suitable dispersant, followed by removing the solvent by heating or reducing pressure, or in alternative, coloring agent particles are adsorbed and fixed through a mechanical sharing force or an electric force to the surface of latex produced by emulsion polymerization or seed polymerization. These methods are effective for suppressing isolation of the coloring agent as additional particles to improve the coloring agent dependency of the charging property.

Examples of the dispersing medium for the binder resin particle dispersion liquid, the coloring agent dispersion liquid and the releasing agent dispersion liquid include an aqueous dispersion medium.

Examples of the aqueous dispersion medium include water, such as distilled water and ion exchanged water, and an alcohol, which may be used solely or in combination of two or more kinds thereof.

The dispersion liquid having particles containing at least the binder resin dispersed therein in the invention can be prepared by mixing the binder resin particle dispersion liquid, the coloring agent dispersion liquid and the releasing agent dispersion liquid, and the mixture is heated to a temperature of from room temperature to the glass transition temperature of the binder resin to aggregate the binder resin particles with the coloring agent and the releasing agent, whereby the aggregated particles are produced. The aggregated particles preferably have a number average particle diameter of from 3 to 10 μm.

The content of the binder resin particles upon mixing the binder resin particle dispersion liquid with the coloring agent dispersion liquid and the like may be 40% by weight or less, and preferably in a range of about from 2 to 20% by weight. The content of the coloring agent may be 50% by weight or less, and preferably in a range of about from 2 to 40% by weight. The content of the other component (particles) may be such an amount that does not impair the target effect of the invention, and is generally a slight amount, specifically about from 0.01 to 5% by weight, and preferably about from 0.5 to 2% by weight.

Subsequently, after completing the aforementioned attaching step depending on necessity, the mixed liquid containing the aggregated particles is subjected to a heat treatment at a temperature higher than the softening point of the resin, generally in a range of from 70 to 120° C., to integrate the aggregated particles, whereby a liquid containing the coloring agent particles. The arithmetic average height of the toner can be controlled by the conditions of the heat treatment. In the case where the heat treatment temperature is increased, the toner surface becomes smooth to reduce the arithmetic average height, and in the case where the heat treatment temperature is lowered, the irregularity on the toner surface is increased to increase the arithmetic average height.

Toner particles are separated from the resulting coloring particle dispersion liquid by centrifugal separation or suction filtration and washed with ion exchanged water from once to thrice. Thereafter, the coloring particles are filtered, washed with ion exchanged water from once to thrice, followed by drying, to obtain the coloring particles used in the invention.

The toner particles may contain a charge controlling agent and a fixing aid, which have been known in the art, depending on necessity.

(External Additive)

The external additive used in the invention will be described.

The toner in the invention preferably contain at least one external additive having a median diameter of 0.1 μm or more and less than 0.3 μm. By using the external additive, stress applied to the toner can be relaxed to maintain the high transfer efficiency.

Examples of the external additive having a median diameter of 0.1 μm or more and less than 0.3 μm include monodisperse spherical particles, and monodisperse spherical silica and monodisperse spherical organic resin particles are preferred, with the monodisperse organic resin particles being preferred as the external additive. The term "monodisperse" referred herein can be defined by the standard deviation of the external additive including aggregated particles thereof with respect to the average particle diameter, and the case where the fluctuation coefficient (ratio of the arithmetic standard deviation to the arithmetic average particle diameter) is 40% or less is defined as being monodisperse. The fluctuation coefficient is preferably 30% or less. The fluctuation coefficient can be obtained by using a laser diffraction and scattering particle size distribution analyzer.

The monodisperse spherical silica can be obtained by a sol-gel process, which is a wet process. The particle diameter of the monodisperse spherical silica can be freely controlled by the conditions for hydrolysis in the sol-gel process, and the weight ratio of an alkoxysilane, ammonia, an alcohol and water, the reaction temperature, the stirring speed and the feeding rate in the polycondensation step. The monodisperse nature and the spherical shape can be attained by the production according to the process.

Specifically, tetramethoxysilane is dropped and stirred in the presence of water and an alcohol with aqueous ammonia as a catalyst under heating. A silica sol suspension liquid thus obtained through the reaction is subjected to centrifugal separation to separate into wet silica gel, an alcohol and aqueous ammonia. The wet silica gel is again dispersed in a solvent to form a silica sol, to which a hydrophobic treating agent is added to make the surface of the silica hydrophobic. The hydrophobic treating agent may be an ordinary silane compound. The solvent is removed from the silica sol having been subjected to the hydrophobic treatment, which is then dried and sieved, to obtain the target monodisperse spherical silica. The silica thus obtained in the aforementioned manner may be again processed. The production process of the monodisperse spherical silica in the invention is not limited to the aforementioned process.

The silane compound may be those having water solubility. Examples of the silane compound include a compound represented by the chemical structural formula $R_aSiX_{4-a}$ (wherein a represents an integer of from 0 to 3, R represents an organic group, such as a hydrogen atom, an alkyl group and an alkenyl group, X represents a hydrolyzable group, such as a chlorine atom, a methoxy group and an ethoxy group). Any type of chlorosilane, alkoxysilane, silazane and a special silylating agent may be used.

Specific examples thereof include methyltrichlorosilane, dimethyldichlorosilane, trimethylchlorosilane, phenyltrichlorsilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-bis(trimethylsilyl)acetamide, N,N-bis(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)triethoxysilane, γ-glycidoxypropyltrimethoxysilane, γ-glycidoxypropylmethyldiethoxysilane, γ-mercaptopropyltrimethoxysilane and γ-chloropropyltrimethoxysilane. Particularly preferred examples of the hydrophobic treating agent in the invention include dimethyldimethoxysilane, hexamethyldisilazane, methyltrimethoxysilane, isobutyltrimethoxysilane and decyltrimethoxysilane.

The addition amount of the monodisperse spherical silica is preferably in a range of from 0.5 to 5 parts by weight, and more preferably from 1 to 3 parts by weight, per 100 parts by weight of the coloring particles. In the case where the addition amount is less than 0.5 part by weight, the effect of reducing the non-electrostatic adhesion force is small, and there are some cases where the improvement effect of development and transferring cannot be obtained. In the case where the addition amount exceeds 5 parts by weight, it exceeds such an amount that forms only one layer coating the surface of the coloring particles to bring about excessive coating, and the silica migrates to a member in contact therewith to induce secondary disorder.

The monodisperse spherical organic resin particles, which are preferably used as the external additive in the invention, will be described.

In order to obtain such hardness that is demanded for the external additive in the invention, the gel fraction of the monodisperse spherical organic resin particles is preferably 90% by weight or more, and more preferably 95% by weight or more. The gel fraction referred herein means a mass ratio of a component that is not dissolved in an organic solvent (tetrahydrofuran) and can be obtained by the following equation.

gel fraction (% by weight)=((mass of component insoluble in organic solvent)/(mass of sample))×100

The gel fraction correlates with the crosslinking degree and the hardness of the resin. In the case where the gel fraction is less than 90% by weight, when the toner containing the external additive is mixed with a carrier in a prescribed ratio to produce a developer for developing an electrostatic latent image (hereinafter, sometimes simply referred to as a "developer"), the spacer effect of the monodisperse spherical organic resin particles is exerted to provide good developing and transferring properties in the initial stage, but the shape of the monodisperse spherical organic resin particles is gradually changed to a planular shape with the lapse of time due to the stress applied to the toner in the developing device, whereby the sufficient spacer effect cannot be exerted to deteriorate the developing and transferring properties.

The monodisperse spherical organic resin particles are preferred because the monodisperse spherical organic resin particles have refractive index of from 1.4 to 1.6, which is the same as the refractive index of the coloring particles of from 1.4 to 1.6. Because the refractive indexes are the same as each other, light scattering at the interface between the coloring particles and the monodisperse spherical organic resin particles on a fixed image, so as to provide excellent color purity in a full color image and excellent light transmission property on an OHP sheet.

The monodisperse spherical organic resin particles in the invention can be obtained, for example, by emulsion-copolymerizing an aromatic ethylenic unsaturated monomer and a monomer having two or more ethylenic unsaturated groups in one molecule in water or a dispersion medium mainly containing water to form an emulsion, which is then dried. The water used as the dispersion medium is preferably ion exchanged water or pure water. The dispersion medium mainly containing water herein means a mixed aqueous solution of water, for example, with an organic solvent, such as methanol, a surfactant, an emulsifier, or a water soluble polymer protective colloid, such as polyvinyl alcohol.

The surfactant, the emulsifier and the protective colloid may have reactive nature or non-reactive nature as far as the target effect of the invention is not impaired. The surfactant, the emulsifier and the protective colloid may be used solely or in combination of two or more kinds thereof.

Examples of the reactive surfactant include an anionic reactive surfactant and a nonionic reactive surfactant, to which a radically polymerizable propenyl group is introduced. The reactive surfactant may be used solely or in combination of two or more kinds thereof.

Examples of the aromatic ethylenic unsaturated monomer used in the invention include styrene, α-methylstyrene, β-methylstyrene, o-methylstyrene, m-methylstyrene, p-methylstyrene, p-ethylstyrene, 2,4-dimethylstyrene, 2,5-dimethylstyrene, 3,4-dimethylstyrene, 3,5-dimethylstyrene, 2,4,5-trimethylstyrene, 2,4,6-trimethylstyrene, p-n-butylstyrene, p-t-butylstyrene, p-n-hexylstyrene, p-n-octylstyrene, p-n-dodecylstyrene, p-methoxystyrene, p-phenylstyrene, p-chlorstyrene, 3,4-dichlorostyrene and potassium styrenesulfonate, and among these, styrene is preferably used. The aromatic ethylenic unsaturated monomer may be used solely or in combination of two or more kinds thereof.

Examples of the monomer having two or more ethylenic unsaturated groups in one molecule (hereinafter, abbreviated as a "polyfunctional ethylenic unsaturated group-containing monomer") used in the invention include divinylbenzene, divinyltoluene, ethylene glycol di(meth)acrylate, ethylene oxide di(meth)acrylate, tetraethylene oxide di(meth)acrylate, 1,6-hexanediol diacrylate, neopentyl glycol diacrylate, trimethylolpropane tri(meth)acrylate, tetramethylolpropane triacrylate and tetramethylolpropane tetra(meth)acrylate. The polyfunctional ethylenic unsaturated group-containing monomer may be used solely or in combination of two or more kinds thereof. The term "(meth)acrylate" referred herein means "acrylate" or "methacrylate".

The polyfunctional ethylenic unsaturated group-containing monomer functions as a crosslinking monomer to contribute to improvement in gel fraction of the resulting particles.

The copolymerization ratio of the aromatic ethylenic unsaturated monomer and the polyfunctional ethylenic unsaturated group-containing monomer is not particularly limited, and it is preferred that the amount of the polyfunctional ethylenic unsaturated group-containing monomer is 0.5 part by weight or more per 100 parts by weight of the aromatic ethylenic unsaturated monomer. In the case where the ratio is in the range, the gel fraction of the resulting particles can be sufficiently improved.

In the invention, a polymerization initiator may be used for initiating or accelerating the emulsion copolymerization through radical polymerization reaction of the aromatic ethylenic unsaturated monomer and the polyfunctional ethylenic unsaturated group-containing monomer.

Examples of the polymerization initiator include a hydrogen peroxide solution and a persulfate salt, such as ammonium persulfate, potassium persulfate and sodium persulfate. The polymerization initiator may be used solely or in combination of two or more kinds thereof.

The production process of the emulsion for obtaining the monodisperse spherical organic resin particles of the invention is not particularly limited, and can be practiced, for example, in the following manner.

In a reaction vessel, such as a separable flask, having a stirrer, a nitrogen introducing tube and a reflux cooler equipped, water or the dispersion medium mainly containing water, the aromatic ethylenic unsaturated monomer and the polyfunctional ethylenic unsaturated group-containing monomer are charged in prescribed amounts. After heating to a temperature of about 70° C. under a stream of an inert gas, such as nitrogen, in constant stirring conditions, the polymerization initiator is added thereto to initiate emulsion copolymerization through radical polymerization reaction. Thereafter, the temperature of the reaction system is maintained at 70° C. to complete the emulsion copolymerization over about 24 hours, and thus the target emulsion can be obtained.

The emulsion thus completed by polymerization may be added with an acid, such as hydrochloric acid and acetic acid, or an alkali, such as sodium hydroxide, to adjust the pH thereof. The emulsion thus obtained is dried, for example, by a freeze drying method or a spray drying method to obtain the monodisperse spherical organic resin particles used in the invention.

The toner for developing an electrostatic latent image of the invention may contain, as an external additive, the monodisperse spherical silica and the monodisperse spherical organic resin particles in combination. An inorganic compound in the form of particles having a particle size distribution showing no monodisperse nature may be used in combination with the monodisperse spherical organic resin particles. Examples of the inorganic compound in the form of particles having a particle size distribution showing no monodisperse nature include known compounds, such as silica, alumina, titania, calcium carbonate, magnesium carbonate, calcium phosphate and cerium oxide. Furthermore, the surface of the inorganic particles may be subjected to a known surface treatment depending on purposes.

Among these, metatitanic acid ($TiO(OH)_2$) does not influence on the transparency to provide such a developer that is excellent in charging property, environmental stability, flowability, caking resistance, stable negative charging property and stable image quality maintenance property. The compound of metatitanic acid having been subjected to a hydrophobic treatment preferably has an electric resistance of $10^{10}$ Ω·cm or more, whereby in the case where the compound is applied to the coloring particles to be used as a toner, no reverse polarity toner is formed upon increasing the transferring electric field to provide high transferring property.

The inorganic compound in the form of particles preferably has a number average particle diameter of 80 nm or less, and more preferably 50 nm or less.

The external additive in the invention is added and mixed with the coloring particles, and the mixing operation may be effected by using a known mixing device, such as a V blender, a HENSCHEL mixer and a LOEDIGE mixer.

At this time, various kinds of additives may be added depending on necessity. Examples of the additive include another fluidizing agent, and a cleaning assistant or a transferring assistant, such as polystyrene particles, polymethyl methacrylate particles and polyvinylidene fluoride particles.

In the invention, the attaching state of the inorganic compound (such as the compound of metatitanic acid having been subjected to a hydrophobic treatment) onto the surface of the coloring particles may be mere mechanical attachment or may be loose fixation. The inorganic compound may cover the entire surface of the coloring particles or only a part of the surface thereof. The addition amount of the inorganic compound is preferably from 0.3 to 3 parts by weight, and more preferably from 0.5 to 2 parts by weight, per 100 parts by weight of the coloring particles. In the case where the addition amount is less than 0.3 part by weight, there are some cases where the flowability of the toner is not insufficient, and suppression of blocking on thermal storage may be insufficient. In the case where the addition amount exceeds 3 parts by weight, on the other hand, there are some cases where the inorganic compound is excessively coated to migrate to a member in contact therewith to induce secondary disorder. It is possible that the coloring particles may be sieved after adding the external additive.

The toner for developing an electrostatic latent image of the invention can be favorably produced by the aforementioned production process, but the production process is not limited thereto.

EXAMPLE

The invention will be described in more detail with reference to the following examples, but the invention is not construed as being limited thereto. In the following description, all the "parts" are "parts by weight".

The production of the carrier for developing an electrostatic latent image, the toner and the developer for developing an electrostatic latent image, and the measurements are carried out in the following manners.

(Measurement of Arithmetic Average Height of Carrier and Toner)

The arithmetic average height of the carrier and the toner is measured by using a color laser three-dimensional profile microscope (VK-9500, produced by Keyence Corp.). In this apparatus, a sample is irradiated with laser light by three-dimensional scanning. The reflected laser light is monitored with a CCD camera by positions to obtain three-dimensional surface information of the sample. The surface information thus obtained is statistically processed to obtain a characteristic value relating to the surface roughness. The three-dimensional measurement is carried out within a viewing field with a lens magnification of 3,000 under the scanning condition of a laser scanning interval in the height direction (Z axis direction) of 0.01 μm over the surface of one particle of the carrier or the toner in a 10 μm square area for the carrier or a 2 μm square area for the toner within the X-Y plane, so as to obtain the arithmetic average height per one particle of the carrier or the toner. In the measurement, γ correction of γ=0.3 is applied, and a smoothing process in height as noise reduction analysis is applied once, so as to obtain the surface roughness. The aforementioned operation is repeated for 240 particles of the carrier and 1,000 particles of the toner, and the resulting data are statistically processed to obtain the arithmetic average height distributions of the carrier and the toner.

(Measurement of Number Average Particle Diameter, Fluctuation of Number Average Particle Diameter, Average Circularity and Fluctuation of Average Circularity of Toner)

The number average particle diameter, the fluctuation of the number average particle diameter, the average circularity and the fluctuation of the average circularity of the toner are measured by using FPIA-2100 (produced by Sysmex Corp.). The apparatus uses a method of measuring particles dispersed in water or the like by a flow type particle image analysis. The particle suspension liquid aspirated into the apparatus is fed to a flat sheath flow cell and formed into a planular sample flow by a sheath liquid. The sample flow is irradiated with strobe light to picture the particles transiting therein as a still image with a CCD camera through an objective lens.

The still image of the particles thus pictured is subjected to a two-dimensional image analysis to calculate a circle-equivalent diameter and circularity from a projected area and a peripheral length. The circle-equivalent diameter is calculated as a diameter of such a circle that has the same area as the area of the target particle in the two-dimensional image. At least 5,000 particles are subjected to the image analysis and the statistic process to obtain the number average particle diameter and the fluctuation of the number average particle diameter. As for the circularity, at least 5,000 particles thus pictured are also subjected to the image analysis and the statistic process to obtain the average circularity and the fluctuation of the average circularity.

$$\text{(Circularity)} = \text{(peripheral length of equivalent circle diameter)}/\text{(Peripheral length)} = (2\times(A\pi)^{1/2})/PM$$

wherein A represents a projected area of the particle, and PM represents a peripheral length of the particle.

The measurement is carried out in the HPF mode (high resolution mode) at a dilution magnification of 1.0 time. Upon analyzing the data, the range for analyzing the number average particle diameter is from 2.0 to 30.1 μm, and the range for analyzing the circularity is from 0.40 to 1.00, for reduction of measurement noise.

(Production of Core Particles)

(Production of Core Particles 1)

| | |
|---|---|
| Ferrite component ($Fe_2O_3$/MgO/MnO = 48.2/23.7/28.1 (% by mole)) | 100 parts |

A mixture of oxides as a raw material of ferrite having the aforementioned composition is wet-mixed in a ball mill, and dried and pulverized. The mixture is then calcined at 900° C. for 1 hour and then pulverized to a size of about from 0.1 to 1.5 mm. The mixture is wet-pulverized in a ball mill to form a slurry, to which 0.8% of polyvinyl alcohol as a binder is added. The slurry is granulated into spherical particles by a spray dryer method and sintered at 1,280° C., followed by classifying, to obtain core particles 1 having an average particle diameter of 48 μm. The resulting core particles 1 have a median of an arithmetic average height (Ra) distribution of 0.63 μm, a fluctuation thereof of 53 and a 90% cumulative value thereof of 1.3 μm.

(Production of Core Particles 2)

Core particles 2 are produced in the same manner as in the production of the core particles 1 except that the sintering temperature is changed to 1,100° C. The resulting core particles 2 have an average particle diameter of 45 μm, a median of an arithmetic average height (Ra) distribution of 0.82 μm, a fluctuation thereof of 62 and a 90% cumulative value thereof of 1.5 μm.

(Production of Core Particles 3)

| | |
|---|---|
| Ferrite component ($Fe_2O_3$/MgO/ZnO/MnO/CuO = 50/25/20/1/4 (% by mole)) | 100 parts |

A mixture of oxides as a raw material of ferrite having the aforementioned composition is wet-mixed in a ball mill, and dried and pulverized. The mixture is then calcined at 900° C. for 1 hour and then pulverized to a size of about from 0.1 to 1.5 mm. The mixture is wet-pulverized in a ball mill to form a slurry, to which 0.8% of polyvinyl alcohol as a binder is added. The slurry is granulated into spherical particles by a spray dryer method and sintered at 1,400° C., followed by classifying, to obtain core particles 3 having an average particle diameter of 50 μm. The resulting core particles 3 have a median of an arithmetic average height (Ra) distribution of 0.48 μm, a fluctuation thereof of 45 and a 90% cumulative value thereof of 0.9 μm.

(Production of Carrier)

(Production of Carrier A)

| | |
|---|---|
| Mixed solvent (toluene and methyl ethyl ketone (4/1)) | 1,000 parts |
| Styrene-methyl methacrylate copolymer (2/8, Mw: 80,000) | 50 parts |
| Methyl methacrylate-perfluorooctylethyl methacrylate copolymer (75/25, Mw: 20,000) | 50 parts |

The aforementioned components are mixed to prepare a raw material solution for forming a coated layer. The solution is mixed with the carrier core particles 1 by adjusting the resin solid content of the solution to 1.5% by weight based on the core particles 1, and the solvent is removed under reduced pressure while mixing in a decompression kneader, followed by classifying through a sieve having an opening of 105 μm, so as to obtain a carrier A. The resulting carrier A has a median of an arithmetic average height (Ra) distribution of 0.48 μm, a fluctuation thereof of 25 and a 90% cumulative value thereof of 0.7 μm.

(Production of Carrier B)

| | |
|---|---|
| Styrene-methyl methacrylate copolymer (90/10, Mw: 25,000) | 2 parts |
| Carbon black (REGA 1330, produced by Cabot Oil & Gas Corp.) | 0.2 part |
| Resin particles (EPOSTAR S (crosslinked melamine resin particles, average particle diameter: 0.3 μm, insoluble in toluene), produced by Nippon Shokubai Co., Ltd.) | 0.3 part |

The aforementioned components are mixed and dispersed for 60 minutes in a stirrer to prepare a raw material solution for forming a coated layer. The solution and 100 parts of the core particles 2 are placed in a vacuum deaeration kneader, and after stirring at 60° C. for 30 minutes, the mixture is deaerated under heating and then dried to obtain a carrier B. The resulting carrier B has a median of an arithmetic average height (Ra) distribution of 0.65 μm, a fluctuation thereof of 52 and a 90% cumulative value thereof of 1.10 μm.

(Production of Carrier C)

| | |
|---|---|
| Styrene-methyl methacrylate copolymer (90/10, Mw: 30,000) | 3.5 parts |
| Carbon black (REGA 1330, produced by Cabot Oil & Gas Corp.) | 0.2 part |
| Resin particles (EPOSTAR S (crosslinked melamine resin particles, average particle diameter: 0.3 μm, insoluble in toluene), produced by Nippon Shokubai Co., Ltd.) | 0.3 part |

The aforementioned components are mixed and dispersed for 60 minutes in a stirrer to prepare a raw material solution for forming a coated layer. The solution and 100 parts of the core particles 1 are placed in a vacuum deaeration kneader, and after stirring at 60° C. for 30 minutes, the mixture is deaerated under heating and then dried to obtain a carrier C. The resulting carrier C has a median of an arithmetic average height (Ra) distribution of 0.51 μm, a fluctuation thereof of 39 and a 90% cumulative value thereof of 0.82 μm.

(Production of Carrier D)

| | |
|---|---|
| Toluene | 1,000 parts |
| Styrene-methyl methacrylate-dimethylaminoethyl methacrylate copolymer (25/70/5, Mw: 80,000) | 100 parts |

The aforementioned components are mixed to prepare a raw material solution for forming a coated layer. The solution is mixed with the carrier core particles 3 by adjusting the resin solid content of the solution to 0.4% by weight based on the core particles 3, and the solvent is removed under reduced pressure while mixing in a decompression kneader, followed by classifying through a sieve having an opening of 105 μm, so as to obtain a carrier D. The resulting carrier D has a median of an arithmetic average height (Ra) distribution of 0.46 μm, a fluctuation thereof of 41 and a 90% cumulative value thereof of 0.80 μm.

(Production of Carrier E)

| | |
|---|---|
| Styrene-methyl methacrylate copolymer (90/10, Mw: 30,000) | 4 parts |
| Carbon black (REGA 1330, produced by Cabot Oil & Gas Corp.) | 0.2 part |
| Resin particles (EPOSTAR S (crosslinked melamine resin particles, average particle diameter: 0.3 μm, insoluble in toluene), produced by Nippon Shokubai Co., Ltd.) | 0.3 part |

The aforementioned components are mixed and dispersed for 60 minutes in a stirrer to prepare a raw material solution for forming a coated layer. The solution and 100 parts of the core particles 3 are placed in a vacuum deaeration kneader, and after stirring at 60° C. for 30 minutes, the mixture is deaerated under heating and then dried to obtain a carrier E. The resulting carrier E has a median of an arithmetic average height (Ra) distribution of 0.39 μm, a fluctuation thereof of 15 and a 90% cumulative value thereof of 0.60 μm.

(Production of Carrier F)

| | |
|---|---|
| Mixed solvent (toluene and methyl ethyl ketone (4/1)) | 1,000 parts |
| Styrene-methyl methacrylate copolymer (2/8, Mw: 80,000) | 20 parts |
| Methyl methacrylate-perfluorooctylethyl methacrylate copolymer (75/25, Mw: 20,000) | 30 parts |

The aforementioned components are mixed to prepare a raw material solution for forming a coated layer. The solution is mixed with the carrier core particles 2 by adjusting the resin solid content of the solution to 0.4% by weight based on the core particles 2, and the solvent is removed under reduced pressure while mixing in a decompression kneader, followed by classifying through a sieve having an opening of 105 μm, so as to obtain a carrier F. The resulting carrier F has a median of an arithmetic average height (Ra) distribution of 0.67 μm, a fluctuation thereof of 60 and a 90% cumulative value thereof of 1.30 μm.

(Production of Coloring Particles)

(Preparation of Resin Dispersion Liquid)

(Preparation of Resin Dispersion Liquid (1))

| | |
|---|---|
| Styrene | 370 parts |
| n-Butyl acrylate | 30 parts |
| Acrylic acid | 8 parts |
| Dodecanethiol | 24 parts |
| Carbon tetrabromide | 4 parts |

A solution obtained by mixing and dissolving the aforementioned components is dispersed and emulsified in a solution obtained by dissolving 6 parts of a nonionic surfactant (NONIPOLE 400, produced by Sanyo Chemicals Co., Ltd.) and 10 parts of an anionic surfactant (NEOGEN SC, produced by Diich Kogyo Seiyaku Co., Ltd.) in 550 parts of ion exchanged water in a flask, to which 50 parts of ion exchanged water having 4 parts of ammonium persulfate dissolved therein is then added over 20 minutes under gradually stirring. After effecting nitrogen substitution, the content of the flask is heated over an oil bath until the temperature of the content becomes 70° C. under stirring, followed by continuing emulsion polymerization under that state for 4 hours.

As a result, a resin dispersion liquid (1) is obtained, which has an average particle diameter of 165 nm, a glass transition temperature (Tg) of 57° C. and a weight average molecular weight Mw of 13,000.

(Preparation of Resin Dispersion Liquid (2))

| | |
|---|---|
| Styrene | 340 parts |
| n-Butyl acrylate | 60 parts |
| Acrylic acid | 8 parts |
| Dodecanethiol | 6 parts |
| Carbon tetrabromide | 4 parts |

A solution obtained by mixing and dissolving the aforementioned components is dispersed and emulsified in a solution obtained by dissolving 6 parts of a nonionic surfactant (NONIPOLE 400, produced by Sanyo Chemicals Co., Ltd.) and 12 parts of an anionic surfactant (NEOGEN SC, produced by Diich Kogyo Seiyaku Co., Ltd.) in 550 parts of ion exchanged water in a flask, to which 50 parts of ion exchanged water having 3 parts of ammonium persulfate dissolved therein is then added over 10 minutes under gradually stirring. After effecting nitrogen substitution, the content of the flask is heated over an oil bath until the temperature of the content becomes 70° C. under stirring, followed by continuing emulsion polymerization under that state for 5 hours.

As a result, a resin dispersion liquid (2) is obtained, which has an average particle diameter of 215 nm, a glass transition temperature (Tg) of 64.8° C. and a weight average molecular weight Mw of 49,000.

(Preparation of Resin Dispersion Liquid (3))

| | |
|---|---|
| Styrene | 330 parts |
| n-Butyl acrylate | 70 parts |
| Acrylic acid | 6 parts |
| Dodecanethiol | 5 parts |
| Carbon tetrabromide | 4 parts |

A solution obtained by mixing and dissolving the aforementioned components is dispersed and emulsified in a solution obtained by dissolving 6 parts of a nonionic surfactant (NONIPOLE 400, produced by Sanyo Chemicals Co., Ltd.) and 10 parts of an anionic surfactant (NEOGEN SC, produced by Diich Kogyo Seiyaku Co., Ltd.) in 550 parts of ion exchanged water in a flask, to which 50 parts of ion exchanged water having 4 parts of ammonium persulfate dissolved therein is then added over 20 minutes under gradually stirring. After effecting nitrogen substitution, the content of the flask is heated over an oil bath until the temperature of the content becomes 80° C. under stirring, followed by continuing emulsion polymerization under that state for 5 hours.

As a result, a resin dispersion liquid (3) is obtained, which has an average particle diameter of 185 nm, a glass transition temperature (Tg) of 62.3° C. and a weight average molecular weight Mw of 47,200.

(Preparation of Resin Dispersion Liquid (4))

| | |
|---|---|
| Styrene | 315 parts |
| n-Butyl acrylate | 85 parts |
| Acrylic acid | 6 parts |
| Dodecanethiol | 6 parts |
| Carbon tetrabromide | 4 parts |

A solution obtained by mixing and dissolving the aforementioned components is dispersed and emulsified in a solution obtained by dissolving 6 parts of a nonionic surfactant (NONIPOLE 400, produced by Sanyo Chemicals Co., Ltd.) and 10 parts of an anionic surfactant (NEOGEN SC, produced by Daiich Kogyo Seiyaku Co., Ltd.) in 550 parts of ion exchanged water in a flask, to which 50 parts of ion exchanged water having 4 parts of ammonium persulfate dissolved therein is then added over 20 minutes under gradually stirring. After effecting nitrogen substitution, the content of the flask is heated over an oil bath until the temperature of the content becomes 80° C. under stirring, followed by continuing emulsion polymerization under that state for 5 hours.

As a result, a resin dispersion liquid (4) is obtained, which has an average particle diameter of 171 nm, a glass transition temperature (Tg) of 54.0° C. and a weight average molecular weight Mw of 34,300.

(Preparation of Resin Dispersion Liquid (5))

| | |
|---|---|
| Styrene | 290 parts |
| n-Butyl acrylate | 110 parts |
| Acrylic acid | 6 parts |
| Dodecanethiol | 6 parts |
| Carbon tetrabromide | 4 parts |

A solution obtained by mixing and dissolving the aforementioned components is dispersed and emulsified in a solution obtained by dissolving 6 parts of a nonionic surfactant (NONIPOLE 400, produced by Sanyo Chemicals Co., Ltd.) and 10 parts of an anionic surfactant (NEOGEN SC, produced by Diich Kogyo Seiyaku Co., Ltd.) in 550 parts of ion exchanged water in a flask, to which 50 parts of ion exchanged water having 4 parts of ammonium persulfate dissolved therein is then added over 20 minutes under gradually stirring. After effecting nitrogen substitution, the content of the flask is heated over an oil bath until the temperature of the content becomes 80° C. under stirring, followed by continuing emulsion polymerization under that state for 5 hours.

As a result, a resin dispersion liquid (5) is obtained, which has an average particle diameter of 125 nm, a glass transition temperature (Tg) of 48.1° C. and a weight average molecular weight Mw of 32,500.

(Preparation of Coloring Agent Dispersion Liquid)

(Preparation of Coloring Agent Dispersion Liquid (1))

| | |
|---|---|
| Cyan pigment (C.I. Pigment Blue B15:3) | 70 parts |
| Nonionic surfactant (NONIPOLE 400, produced by Sanyo Chemicals Co., Ltd.) | 5 parts |
| Ion exchanged water | 200 parts |

The aforementioned components are mixed and dispersed by using a homogenizer (ULTRA TURRAX T50, produced by IKA Works Inc.) for 10 minutes to obtain a coloring agent dispersion liquid (1) having coloring agent (cyan pigment) particles having an average particle diameter of 220 nm dispersed therein.

(Preparation of Coloring Agent Dispersion Liquid (2))

| | |
|---|---|
| Magenta pigment (C.I. Pigment Red 122) | 70 parts |
| Nonionic surfactant (NONIPOLE 400, produced by Sanyo Chemicals Co., Ltd.) | 5 parts |
| Ion exchanged water | 200 parts |

The aforementioned components are mixed and dispersed by using a homogenizer (ULTRA TURRAX T50, produced by IKA Works Inc.) for 10 minutes to obtain a coloring agent dispersion liquid (2) having coloring agent (magenta pigment) particles having an average particle diameter of 210 nm dispersed therein.

(Preparation of Releasing Agent Dispersion Liquid)

| | |
|---|---|
| Paraffin wax (HNP0190, produced by Nippon Seiro Co., Ltd., melting point: 85° C.) | 50 parts |
| Cationic surfactant (SANISOL B50, produced by Kao Corp.) | 5 parts |
| Ion exchanged water | 200 parts |

The aforementioned components are dispersed in a round stainless steel flask by using a homogenizer (ULTRA TURRAX T50, produced by IKA Works Inc.) for 10 minutes and then dispersed with a pressure discharge homogenizer to obtain a releasing agent dispersion liquid (1) having releasing agent particles having an average particle diameter of 160 nm dispersed therein.

(Production of Toner)

(Production of Toner A)

| | |
|---|---|
| Resin dispersion liquid (5) | 150 parts |
| Coloring agent dispersion liquid (1) | 200 parts |
| Releasing agent dispersion liquid (1) | 40 parts |
| Cationic surfactant (Sanisol B50, produced by Kao Corp.) | 1.5 parts |

The aforementioned components are dispersed in a round stainless steel flask by using a homogenizer (ULTRA TURRAX T50, produced by IKA Works Inc.), and the temperature of the mixture is increased over an oil bath to 48° C. over 150 minutes, and further increased to 52° C. over 100 minutes. At a temperature of 52° C., 50 parts of the resin dispersion liquid (2) and 50 parts of resin dispersion liquid (3) are added thereto. After allowing to stand for 15 minutes, 3 parts of an anionic surfactant (Neegen-NEOGEN RK, produced by Daiich Kogyo Seiyaku Co., Ltd.) is added, and after sealing the stainless steel flask, the mixture is heated to 93° C. under stirring by using a magnetic seal, followed by maintaining at 93° C. for 2 hours. After cooling, the reaction product is filtered, sufficiently washed with ion exchanged water and dried to obtain cyan toner particles. 0.4% by weight of silica (R972, produced by Nippon Aerosil Co., Ltd.) is added to the resulting cyan toner particles by a HENSCHEL mixer to obtain cyan toner particles (toner A). The resulting toner particles A have an average circularity of 0.979, a median of an arithmetic average height (Ra) distribution of 0.102 μm and a fluctuation thereof of 28.3.

(Production of Toner B)

| | |
|---|---|
| Resin dispersion liquid (1) | 180 parts |
| Coloring agent dispersion liquid (1) | 250 parts |
| Releasing agent dispersion liquid (1) | 50 parts |
| Cationic surfactant (SANISOL B50, produced by Kao Corp.) | 1.5 parts |

The aforementioned components are dispersed in a round stainless steel flask by using a homogenizer (ULTRA TURRAX T50, produced by IKA Works Inc.), and the temperature of the mixture is increased over an oil bath to 60° C. over 300 minutes. At a temperature of 60° C., 50 parts of the resin dispersion liquid (5) is added thereto. After allowing to stand for 15 minutes, 3 parts of an anionic surfactant (NEOGEN RK, produced by Daiich Kogyo Seiyaku Co., Ltd.) is added, and after sealing the stainless steel flask, the mixture is heated to 93° C. under stirring by using a magnetic seal, followed by maintaining at 93° C. for 5 hours. After cooling, the reaction product is filtered, sufficiently washed with ion exchanged water and dried to obtain cyan toner particles. 0.4% by weight of silica (R972, produced by Nippon Aerosil Co., Ltd.) is added to the resulting cyan toner particles by a HENSCHEL mixer to obtain cyan toner particles (toner B). The resulting toner particles B have an average circularity of 0.983, a median of an arithmetic average height (Ra) distribution of 0.096 μm and a fluctuation thereof of 26.8.

(Production of Toner C)

| | |
|---|---|
| Resin dispersion liquid (1) | 150 parts |
| Resin dispersion liquid (2) | 25 parts |
| Coloring agent dispersion liquid (2) | 200 parts |
| Releasing agent dispersion liquid (1) | 60 parts |
| Cationic surfactant (SANISOL B50, produced by Kao Corp.) | 1.5 parts |

The aforementioned components are dispersed in a round stainless steel flask by using a homogenizer (ULTRA TURRAX T50, produced by IKA Works Inc.), and the temperature of the mixture is increased over an oil bath to 56° C. over 30 minutes. At a temperature of 56° C., 100 parts of the resin dispersion liquid (4) is added thereto. After allowing to stand for 120 minutes, 3 parts of an anionic surfactant (NEOGEN RK, produced by Daiich Kogyo Seiyaku Co., Ltd.) is added, and after sealing the stainless steel flask, the mixture is heated to 96° C. under stirring by using a magnetic seal, followed by maintaining at 96° C. for 5 hours. After cooling, the reaction product is filtered, sufficiently washed with ion exchanged water and dried to obtain magenta toner particles. 0.4% by weight of silica (R972, produced by Nippon Aerosil Co., Ltd.) is added to the resulting magenta toner particles by a HENSCHEL mixer to obtain magenta toner particles (toner C). The resulting toner particles C have an average circularity of 0.983, a median of an arithmetic average height (Ra) distribution of 0.085 μm and a fluctuation thereof of 31.3.

(Production of Toner D)

| | |
|---|---|
| Resin dispersion liquid (5) | 150 parts |
| Coloring agent dispersion liquid (1) | 220 parts |
| Releasing agent dispersion liquid (1) | 50 parts |
| Cationic surfactant (SANISOL B50, produced by Kao Corp.) | 1.5 parts |

The aforementioned components are dispersed in a round stainless steel flask by using a homogenizer (ULTRA TURRAX T50, produced by IKA Works Inc.), and the temperature of the mixture is increased over an oil bath to 50° C. over 150 minutes. At a temperature of 50° C., 75 parts of the resin dispersion liquid (2) and 75 parts of the resin dispersion liquid (3) are added thereto. After allowing to stand for 15 minutes, 3 parts of an anionic surfactant (NEOGEN RK, produced by Daiich Kogyo Seiyaku Co., Ltd.) is added, and after sealing the stainless steel flask, the mixture is heated to 93° C. under stirring by using a magnetic seal, followed by maintaining at 93° C. for 12 hours. After cooling, the reaction product is filtered, sufficiently washed with ion exchanged water and dried to obtain cyan toner particles. 0.4% by weight of silica (R972, produced by Nippon Aerosil Co., Ltd.) is added to the resulting cyan toner particles by a HENSCHEL mixer to obtain cyan toner particles (toner D). The resulting toner particles D have an average circularity of 0.965, a median of an arithmetic average height (Ra) distribution of 0.135 μm and a fluctuation thereof of 52.0.

(Production of Toner E)

| | |
|---|---|
| Resin dispersion liquid (1) | 150 parts |
| Resin dispersion liquid (2) | 150 parts |
| Coloring agent dispersion liquid (2) | 190 parts |
| Releasing agent dispersion liquid (1) | 55 parts |
| Cationic surfactant (SANISOL B50, produced by Kao Corp.) | 1.5 parts |

The aforementioned components are dispersed in a round stainless steel flask by using a homogenizer (ULTRA TURRAX T50, produced by IKA Works Inc.), and the temperature of the mixture is increased over an oil bath to 56° C. over 130 minutes. At a temperature of 56° C., 100 parts of the resin dispersion liquid (5) is added thereto. After allowing to stand for 10 minutes, 3 parts of an anionic surfactant (NEOGEN RK, produced by Daiich Kogyo Seiyaku Co., Ltd.) is added, and after sealing the stainless steel flask, the mixture is heated to 96° C. under stirring by using a magnetic seal, followed by maintaining at 96° C. for 3 hours. After cooling, the reaction product is filtered, sufficiently washed with ion exchanged water and dried to obtain magenta toner particles. 0.4% by weight of silica (R972, produced by Nippon Aerosil Co., Ltd.) is added to the resulting magenta toner particles by a HENSCHEL mixer to obtain magenta toner particles (toner E). The resulting toner particles E have an average circularity of 0.970, a median of an arithmetic average height (Ra) distribution of 0.119 μm and a fluctuation thereof of 45.0.

Example 1

| | |
|---|---|
| Carrier A | 93 parts |
| Toner particles A | 7 parts |

The aforementioned components are mixed by stirring by using a V blender at 20 rpm for 20 minutes and classified by sieving with 212 μm-mesh to obtain a developer 1.

Example 2

| | |
|---|---|
| Carrier B | 93 parts |
| Toner particles A | 7 parts |

The aforementioned components are mixed by stirring in the same manner as in Example 1 to obtain a developer 2.

Example 3

| | |
|---|---|
| Carrier C | 93 parts |
| Toner particles B | 7 parts |

The aforementioned components are mixed by stirring in the same manner as in Example 1 to obtain a developer 3.

Example 4

| | |
|---|---|
| Carrier C | 93 parts |
| Toner particles C | 7 parts |

The aforementioned components are mixed by stirring in the same manner as in Example 1 to obtain a developer 4.

Example 5

| | |
|---|---|
| Carrier D | 93 parts |
| Toner particles C | 7 parts |

The aforementioned components are mixed by stirring in the same manner as in Example 1 to obtain a developer 5.

Comparative Example 1

| | |
|---|---|
| Carrier E | 93 parts |
| Toner particles A | 7 parts |

The aforementioned components are mixed by stirring in the same manner as in Example 1 to obtain a developer 6.

Comparative Example 2

| | |
|---|---|
| Carrier F | 93 parts |
| Toner particles B | 7 parts |

The aforementioned components are mixed by stirring in the same manner as in Example 1 to obtain a developer 7.

Comparative Example 3

| | |
|---|---|
| Carrier E | 93 parts |
| Toner particles D | 7 parts |

The aforementioned components are mixed by stirring in the same manner as in Example 1 to obtain a developer 8.

Comparative Example 4

| | |
|---|---|
| Carrier C | 93 parts |
| Toner particles E | 7 parts |

The aforementioned components are mixed by stirring in the same manner as in Example 1 to obtain a developer 9.

(Evaluation Method)

30,000 sheets are printed by using a modified machine of DOCUCENTRE COLOR 400, produced by Fuji Xerox Co., Ltd. under an ordinary temperature and ordinary humidity condition (22° C., 55% RH), a high temperature and high humidity condition (30° C., 85% RH) and a low temperature and low humidity condition (10° C., 20% RH), and the state of the toner fixed on the photoreceptor and the image quality (presence of image blue due to a discharge product) are evaluated after printing 100 sheets and 30,000 sheets. DOCUCENTRE COLOR 400 is modified by removing the blade cleaner on the photoreceptor to enable evaluation of the cleaner-less system. The charging system of the photoreceptor is a contact charging system, and the transfer system is an intermediate transfer belt.

Image defects are liable to occur significantly under the high temperature and high humidity condition. Accordingly, after printing the prescribed number of sheets under the respective conditions, the test machine is allowed to stand under the high temperature and high humidity condition over day and night, and then a half tone image is printed to evaluate image quality in terms of extent of occurrence and recovery of image blue.

The evaluation standards are shown below.

(Toner Fixation)

Fixation of the toner is confirmed visually.

A: No toner fixation is observed.

B: Slight toner fixation is observed but removed by rubbing with dry cloth.

C: Significant toner fixation is observed and cannot be removed by rubbing with dry cloth.

(Image Quality)

A: Upon continuous printing of a half tone image, no image blur occurs, and no image defect occurs.

B: Upon continuous printing of a half tone image, image blur occurs but disappears after continuous printing of 10 sheets or less, and slight image defect occurs.

C: Upon continuous printing of a half tone image, image blur occurs and does not disappear after continuous printing of 10 sheets or more, and significant image defect occurs.

The results obtained are shown in Table 1 below.

TABLE 1

| | Arithmetic average height of carrier | | | Arithmetic average height of toner | | | After printing 100 sheets | | After printing 30,000 sheets | |
|---|---|---|---|---|---|---|---|---|---|---|
| | Median (μm) | Fluctuation | 90% cumulative Fluctuation (μm) | Average circularity | Median (μm) | value (μm) | Toner fixation | Image quality | Toner fixation | Image quality |
| Example 1 | 0.48 | 25 | 0.70 | 0.979 | 0.102 | 28.3 | A | A | A | A |
| Example 2 | 0.65 | 52 | 1.10 | 0.979 | 0.102 | 28.3 | A | A | A | A |
| Example 3 | 0.51 | 39 | 0.82 | 0.983 | 0.096 | 26.8 | A | A | A | A |
| Example 4 | 0.51 | 39 | 0.82 | 0.983 | 0.085 | 31.3 | A | A | A | A |
| Example 5 | 0.46 | 41 | 0.80 | 0.983 | 0.085 | 31.3 | A | A | A | A |
| Comparative Example 1 | 0.39 | 15 | 0.60 | 0.979 | 0.102 | 28.3 | A | B | B | C |
| Comparative Example 2 | 0.67 | 60 | 1.30 | 0.983 | 0.096 | 26.8 | A | A | A | C |
| Comparative Example 3 | 0.39 | 15 | 0.60 | 0.965 | 0.135 | 52.0 | A | B | C | C |
| Comparative Example 4 | 0.51 | 39 | 0.82 | 0.970 | 0.119 | 45.0 | A | A | C | B |

In the case where the developers 1 to 5 obtained in Examples 1 to 5 are used, no fixation of the toner is observed, and image blur due to discharge products does not occur, to maintain good image quality in the initial stage and even after printing 30,000 sheets.

In the case where the developer 6 obtained in Comparative Example 1 is used, on the other hand, the carrier having a small arithmetic average height is inferior in scraping effect for discharge products and the remaining toner to cause image blur even in the initial stage. After printing 30,000 sheets, fixation of the toner onto the photoreceptor occurs, and image blur is conspicuously occurs in areas where no toner fixation occurs, so as to provide insufficient image quality. In Comparative Example 2, the carrier having a large arithmetic average height exerts effect on removing the toner, but due to the excessive scraping effect, the surface of the photoreceptor is damaged to cause image defects. In Comparative Example 3 using the same carrier as in Comparative Example 1, the toner having a small circularity lowers the transfer efficiency, whereby fixation of the toner conspicuously occurs to bring about charging and exposing failure after printing 30,000 sheets. In Comparative Example 4, the toner having a large fluctuation lowers the transfer efficiency, and as a result, fixation of the toner and image defects are induced.

What is claimed is:

1. A developer for developing an electrostatic latent image, the developer comprising:

a carrier comprising a core material and a coating resin; and a toner including coloring particles which at least contain a binder resin, a coloring agent and a releasing agent, and an external additive, wherein the carrier has a median of an arithmetic average height distribution of from 0.45 to 0.65 μm, the core material has a volume average particle diameter of from 10 to 55 μm, the core material comprises magnetic particles having a saturation magnetization at 3,000 Oe of 50 $A \cdot m^2/kg$ or more, the toner has an average circularity of 0.975 or more, and the circularity is defined by:

$$\text{(Circularity)} = \text{(peripheral length of equivalent circle diameter)} / \text{(Peripheral length)} = (2 \times (A\pi)^{1/2}) / PM$$

where A represents a projected area of a particle, and PM represents a peripheral length of a particle.

2. The developer according to claim 1, wherein a surface of the toner has a fluctuation of an arithmetic average height of from 25 to 35.

3. The developer according to claim 1, wherein a surface of the toner has a median of an arithmetic average height distribution of from 0.05 to 0.12 μm.

4. The developer according to claim 1, wherein a surface of the carrier has a 90% cumulative frequency value of an arithmetic average height distribution of 0.8 μm or more.

5. The developer according to claim 1, wherein the core material comprises ferrite.

6. The developer according to claim 1, wherein the coating resin contains a conductive powder.

7. The developer according to claim 6, wherein the conductive powder has a conductivity of $1 \times 10^{10}$ Ω·cm or less.

8. The developer according to claim 1, wherein the toner has a number average particle diameter of from 5.0 to 7.0 μm.

9. The developer according to claim 1, wherein the external additive has a median diameter of 0.1 μm or more and less than 0.3 μm.

10. The developer according to claim 1, wherein the external additive has a fluctuation coefficient of 40% or less, and the fluctuation coefficient is defined by a ratio of an arithmetic standard deviation to an arithmetic average particle diameter.

11. A cleaner-less image forming method comprising:

forming an electrostatic latent image on a electrostatic latent image carrying member;

developing the electrostatic latent image with a developer comprising a toner and a carrier to form a toner image, the carrier comprising a core material and a coating resin, and the toner including coloring particles which at least contain a binder resin, a coloring agent and a releasing agent, and an external additive;

transferring the toner image to a fixing substrate; and fixing the transferred toner image to the fixing substrate by heating, wherein the carrier has a median of an arithmetic average height distribution of from 0.45 to 0.65 μm, the core material has a volume average particle diameter of from 10 to 55 μm, the core material comprises magnetic particles having a saturation magnetization at 3,000 Oe of 50 $A \cdot m^2/kg$ or more, the toner has an average circularity of 0.975 or more, and the circularity is defined by:

$$\text{(Circularity)} = \text{(peripheral length of equivalent circle diameter)} / \text{(Peripheral length)} = (2 \times (A\pi)^{1/2}) / PM$$

where A represents a projected area of a particle, and PM represents a peripheral length of a particle.

12. The cleaner-less image forming method according to claim 11, wherein a surface of the toner has a fluctuation of an arithmetic average height of from 25 to 35.

13. The cleaner-less image forming method according to claim 11, wherein a surface of the toner has a median of an arithmetic average height distribution of from 0.05 to 0.12 μm.

14. The cleaner-less image forming method according to claim 11, wherein a surface of the carrier has a 90% cumulative frequency value of an arithmetic average height distribution of 0.8 μm or more.

15. The cleaner-less image forming method according to claim 11, wherein the external additive has a median diameter of 0.1 μm or more and less than 0.3 μm.

16. The cleaner-less image forming method according to claim 11, wherein the external additive has a fluctuation coefficient of 40% or less, and the fluctuation coefficient is defined by a ratio of an arithmetic standard deviation to an arithmetic average particle diameter.

* * * * *